US008966793B1

(12) United States Patent
Custren

(10) Patent No.: US 8,966,793 B1
(45) Date of Patent: Mar. 3, 2015

(54) DATE INDICATING DEVICE

(71) Applicant: Thomas E. Custren, Hatboro, PA (US)

(72) Inventor: Thomas E. Custren, Hatboro, PA (US)

( * ) Notice: Subject to any disclaimer, the term of this patent is extended or adjusted under 35 U.S.C. 154(b) by 100 days.

(21) Appl. No.: 13/738,306

(22) Filed: Jan. 10, 2013

(51) Int. Cl.

| | |
|---|---|
| ***G09F 9/00*** | (2006.01) |
| ***G09F 9/40*** | (2006.01) |
| ***G09D 3/06*** | (2006.01) |
| ***G09D 3/00*** | (2006.01) |

(52) U.S. Cl.
CPC ... *G09D 3/06* (2013.01); *G09D 3/00* (2013.01)
USPC ..... 40/111; 40/495; 116/294

(58) Field of Classification Search
USPC ..... 40/107–120, 493, 503; 116/295, 284, 116/308; 235/117 R, 114
See application file for complete search history.

(56) References Cited

U.S. PATENT DOCUMENTS

| | | | | |
|---|---|---|---|---|
| 1,183,818 | A * | 5/1916 | Hunnicutt | 40/495 |
| 2,533,883 | A * | 12/1950 | Gelb | 116/318 |
| 2,817,451 | A | 12/1957 | Giles et al. | |
| 4,261,121 | A * | 4/1981 | Coon | 40/332 |
| 4,985,879 | A | 1/1991 | Owens | |
| 5,112,276 | A * | 5/1992 | Spaeth | 453/54 |
| 5,377,612 | A * | 1/1995 | Catalano et al. | 116/234 |
| 5,474,018 | A * | 12/1995 | Lopez | 116/311 |
| 5,802,015 | A | 9/1998 | Rothschild et al. | |
| D401,526 | S | 11/1998 | Stunder | |
| D417,167 | S | 11/1999 | Stunder | |
| 6,337,836 | B1 | 1/2002 | Eidelson | |
| D470,007 | S | 2/2003 | D'Alessio et al. | |
| 6,817,192 | B2 | 11/2004 | Ector, Jr. et al. | |
| 7,264,120 | B2 | 9/2007 | Turvey et al. | |
| 7,742,360 | B1 | 6/2010 | Price | |
| 2007/0091726 | A1 | 4/2007 | Stauffer et al. | |
| 2011/0109453 | A1 | 5/2011 | Chen | |
| 2012/0006252 | A1 * | 1/2012 | Warner et al. | 116/284 |

* cited by examiner

*Primary Examiner* — Casandra Davis
(74) *Attorney, Agent, or Firm* — Robert C. Montgomery; Montgomery Patent & Design

(57) ABSTRACT

A date indicating device attachable to food storage containers is selectably set to indicate the date that the food product inside of the container. The device can be attached to the upper rim of the lid or handle of the container. The device includes a plurality of adjustable knobs which enable the date to be set and includes the month, day, and year.

18 Claims, 4 Drawing Sheets

DATE INDICATING DEVICE

RELATED APPLICATIONS

Not applicable.

FIELD OF THE INVENTION

The present invention relates generally to date identifying devices, and in particular, to a date indicating device for food products that is attachable to a food storage container.

BACKGROUND OF THE INVENTION

While grocery shopping, one must be constantly aware of product dating codes in order to ensure that safe and fresh food products are purchased. This practice, however, does not end at the grocery store. Rather, it is equally important to monitor the expiration date on products in the home to make sure that only the freshest, non-outdated food is consumed. This is especially the case where prepared food or leftovers are placed in the refrigerator for future use. While containers can be provided with labels, such labels can fall off, become smeared or even become confusing when remarked with other dates. Similar problems exist in restaurant and food preparation industries where legal ramifications of using outdated food can be costly.

Accordingly, there exists a need for a means by which food product containers can be easily marked with the current date during initial storage in an effort to address the above-mentioned problems.

SUMMARY OF THE INVENTION

The inventor has recognized the aforementioned inherent problems and lack in the art and observed that there is a need for a device that ensures food products in storage containers are fresh in a manner which is quick, easy, and effective. The development of the present invention, which will be described in greater detail herein, substantially departs from conventional solutions to provide a date indicating device and in doing so fulfills this need.

In one (1) embodiment, the disclosed date indicating device can include an enclosure defining a hollow internal volume, a spring clamp attached to an exterior of the enclosure, a plurality of date indicia disposed within the internal volume and visible through the enclosure to visually indicate a date, and a plurality of adjustable knobs disposed within the internal volume and mechanically connected to the date indicia configured to set the date.

In another embodiment, the disclosed date indicating device can include an enclosure having a top panel, a bottom panel opposite the top panel, a front panel, a rear panel laterally opposed to the front panel, and a pair of longitudinally opposed side panels defining a hollow internal volume, a spring clamp attached to the enclosure, a first knob rotatably attached to the rear panel and protruding through the front panel, a second knob rotatably attached to the rear panel and protruding through the front panel, a third knob rotatably attached to the rear panel and protruding through the front panel, a month gear rotatably attached to the rear panel and mechanically connected to the first knob, the month gear having a plurality of month indicia visible through the front panel, a day gear rotatably attached to the rear panel and mechanically connected to the second knob, the day gear having a plurality of day indicia visible through the front panel, and a year gear rotatably attached to the rear panel and mechanically connected to the third knob, the year gear having a plurality of year indicia visible through the front panel.

Furthermore, the described features and advantages of the disclosed date indicating device can be combined in various manners and embodiments as one skilled in the relevant art will recognize after reading the present disclosure. The disclosure can be practiced without one (1) or more of the features and advantages described in any particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
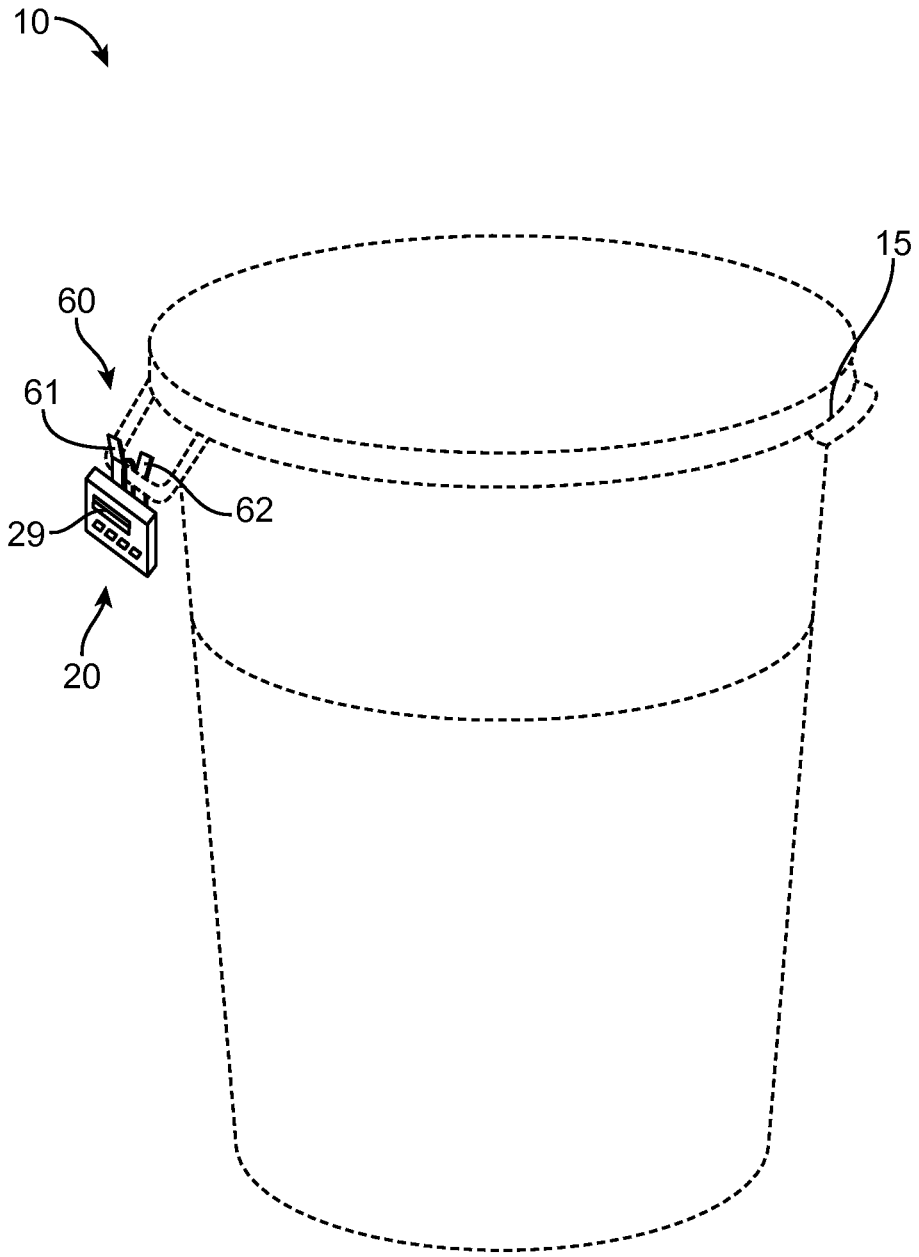
FIG. 1 is an environmental view of a date indicating device in accordance with the present invention.

10 date indicating device
15 container
20 enclosure
21 top panel
22 front panel
23 side panel
24 rear panel
25 bottom panel
26 interior
27 writing opening
28 indicia
29 cover
30 handle
31 track
32 writing surface
33 month knob opening
34 month opening
35 day knob opening
36 day opening
37 year knob opening
38 year opening
40 first gear
41 first knob
42 first gear axle
43 month gear
44 month gear axle
45 month gear indicia
46 second gear
47 second knob
48 second gear axle
49 day gear
50 day gear axle
51 day gear indicia
52 third gear
53 third knob
54 third gear axle

55 year gear
56 year gear axle
57 year gear indicia
60 clamp
61 fixed member
62 clamping member
63 spring
64 gap

DETAILED DESCRIPTION OF THE PREFERRED EMBODIMENT

In accordance with the invention, the best mode is presented in terms of the described embodiments, herein depicted within FIGS. 1 through 5. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only certain configurations have been shown and described for purposes of clarity and disclosure and not by way of limitation of scope.

It can be appreciated that, although such terms as first, second, etc. may be used herein to describe various elements, these elements should not be limited by these terms. These terms are only used to distinguish one (1) element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one (1) or more stated elements, steps or functions without precluding one or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

Referring now to FIGS. 1 through 5, disclosing a date indicating device (herein generally described as a "device") 10, where like reference numerals represent similar or like parts. In accordance with the invention, the present disclosure describes a device 10 that particularly suited for providing a selective means for keeping track of the date foodstuffs were initially stored within a container 15.

Referring now to FIG. 1, the device 10 is depicted as being attached to handle of a container 15 in an upright orientation. The container 15 is depicted as a restaurant-style bulk container which is utilized to store a quantity of foodstuffs, yet it can be appreciated that other styles and types of storage containers can be utilized without limiting the scope of the present disclosure. The device 10 can be clamped onto an edge of the container handle and a date that the enclosed foodstuff was initially stored can be set to keep track of the freshness of the enclosed foodstuff. The device 10 can be positioned in a location which is easily visible to show the date upon the container 15 and also positioned in a manner which enables the containers 15 to be stacked upon each other.

Figure 2:
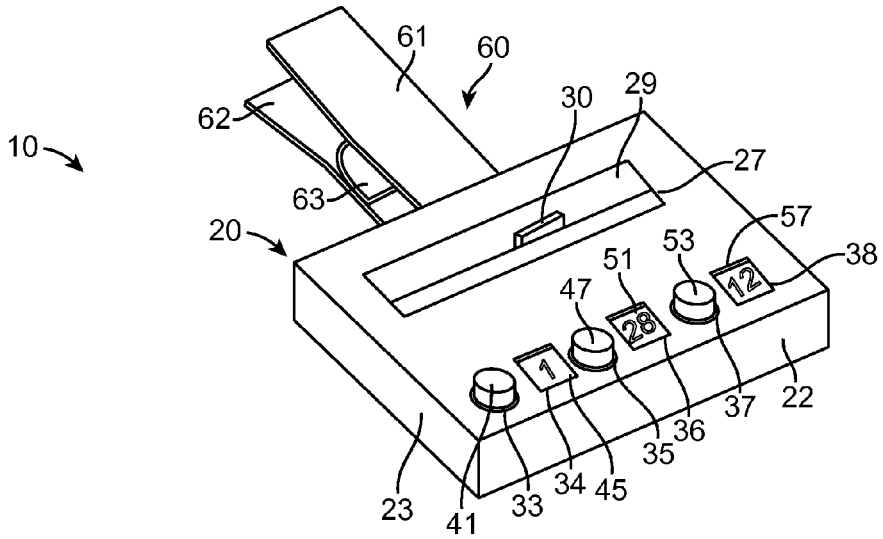
FIG. 2 is a perspective front view of the date indicating device.
Figure 3:
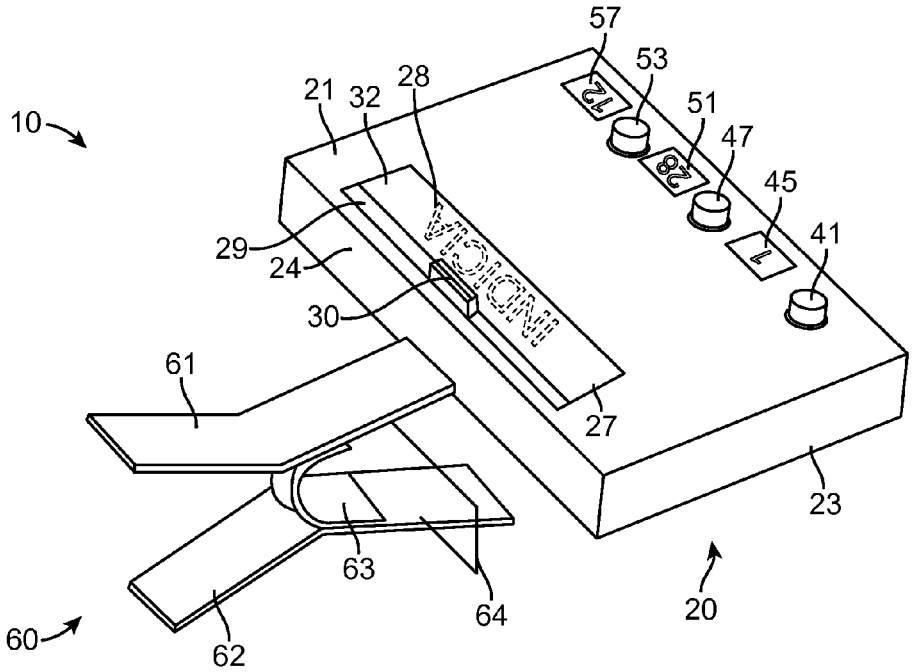
FIG. 3 is a perspective rear view of the date indicating device.
Figure 4:
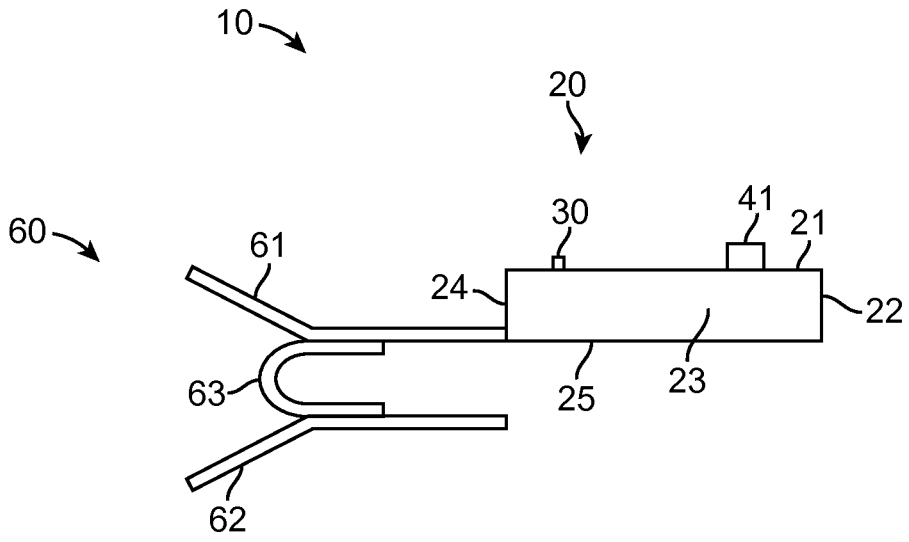
FIG. 4 is a side view of the date indicating device.

Referring now to FIGS. 2 through 4, the device 10 can include an enclosure 20 which displays the date, provides a writing surface, and protects a plurality of internal mechanisms. The device 10 can also include a clamp 60 for attachment of the device 10 to the container 15. The enclosure 20 and clamp 60 are preferably fabricated of a durable plastic, yet other materials may be utilized without limiting the scope of the disclosure.

The enclosure 20 can include a generally rectangular, six-sided member further having a top panel 21, a front panel 22, a pair of side panels 23, a rear panel 24, and a bottom panel 25. The top panel 21 includes the components which can be manipulated to change the date and label what is stored in the container 15. The bottom panel 25 can be positioned adjacent to the exterior surface of the container 15 in order for the top panel 21 to be positioned away from the container 15 and visible.

The top panel 21 can include a writing opening 27 (also see FIG. 5) which provides access to a writing surface 32 for the user to write indicia 28, which may include a name or description of what is being stored within the container 15. The writing opening 27 includes a cover 29 which slides over the writing surface 32 via an internal track 31 to conceal the writing surface 32. The cover 29 also includes an integral handle 30 which protrudes upwardly from the cover 29 to enable the user to grasp and motion the cover 29 as needed. The handle 30 also provides a limiting means to the cover 29 to prohibit the cover 29 from traveling past the confines of the writing opening 27.

Figure 5:
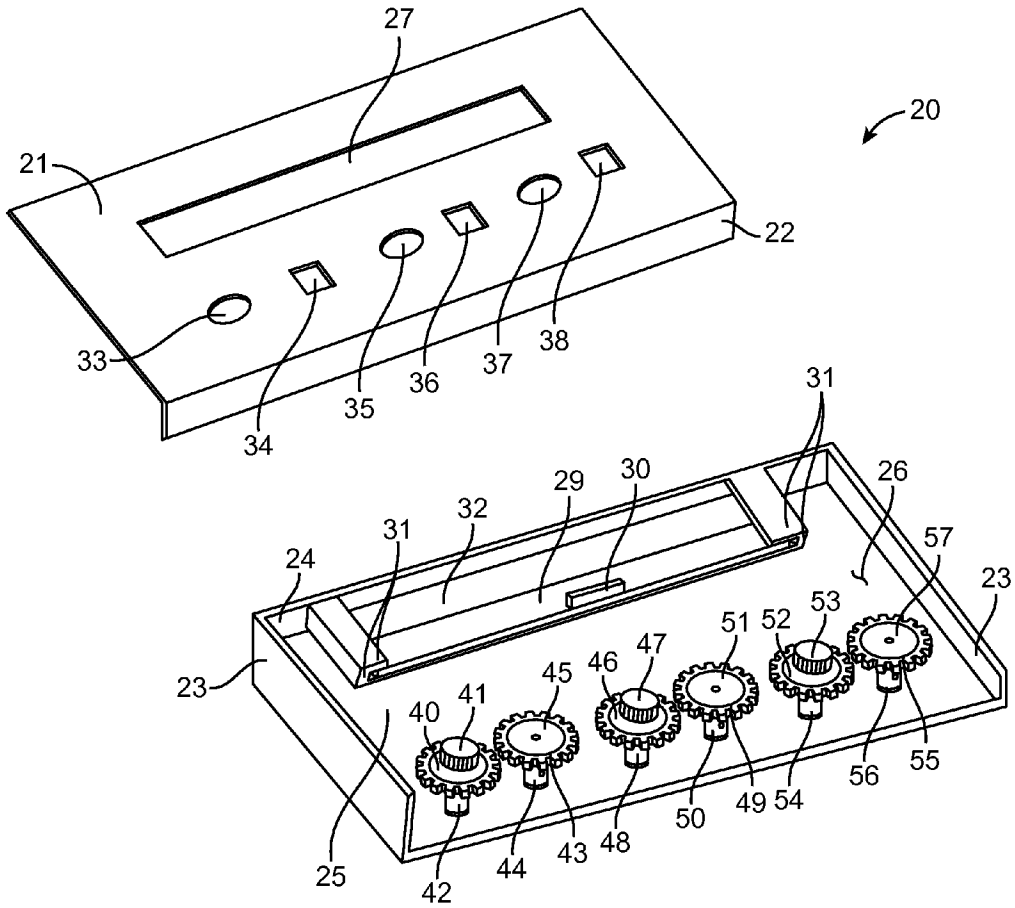
FIG. 5 is a partially exploded perspective view of an enclosure of the date indicating device.

The top panel 21 also includes a plurality of knobs 41, 47, 53 which are manually manipulated by the user to set respective numeric indicia 45, 51, 57 providing a date setting means (also see FIG. 5). The knobs 41, 47, 53 are depicted as being positioned linearly below the writing surface 32 for illustration purposes only; however, it can be appreciated that other locations upon the top panel 21 may be utilized without limiting the scope of the present disclosure. A first knob 41 manipulates the month, a second knob 47 manipulates the day, and a third knob 53 manipulates the year.

A rear panel 24 of the enclosure 20 includes the clamp 60 which provides a spring-actuated means of attaching the device 10 to the container 15. The clamp 60 includes a fixed member 61 which is integral to and protrudes from the rear panel 24. The fixed member 61 includes a slight "L"-shape for illustration purposes only and it can be appreciated that other shapes may be utilized without limiting the scope of the disclosure. A "U"-shaped spring 63 fabricated from a plastic material, having elastic characteristics, is attached via welding techniques to an underside surface of the fixed member 61. The spring 63 enables a clamping member 62 to actuate to an open or closed state. The spring 63 is also attached to an upper surface of the clamping member 62 via welding techniques. The height of the clamp 63 creates a gap 64 between the fixed member 61 and the clamping member 62 which enables the clamp 60 to attach to a container 16. The members 61, 62 are depressed towards each other to increase the gap 64 and enable placement on the container 15. The members 61, 62 are released to fasten the clamp 60 in a fixed position on the container 15.

Referring now to FIG. 5, the top panel 21 and the front panel 22 are removed from the enclosure 20 for illustration purposes only; however, it can be appreciated that the enclosure 20 is to be completely enclosed. The top panel 21 includes the writing opening 27, knob openings 33, 35, 37, a month opening 34, a day opening 36, and a year opening 38. The writing opening 27 frames the writing surface 36 and cover 29. The writing opening 27 also prohibits the cover 29 from accidently being removed because the handle 30 extends beyond the writing opening 27 acting as a stop for travel of the cover 29. Each knob opening 33, 35, 37 enables a respective knob 41, 47, 53 to be exposed for use. Also each knob opening 33, 35, 37 is slightly larger in diameter than the respective knob 41, 47, 53 to enable placement and usage. The month opening 34 enables a single numeral upon the month gear indicia 45 to be visible. The day opening 36 enables a single numeral upon the day gear indicia 51 to be visible. The year opening 38 enables a single numeral upon the year gear indicia 57 to be visible.

The rear panel 24 includes an integral track 31 having a "C"-shaped cross-section upon each opposing side which protrudes inwardly. The cover 29 is inserted within the track 31, which enables the cover 29 to travel within. The track 31 is preferably fabricated from a material similar to the enclosure 20, yet other materials may be utilized without limiting the scope of the disclosure. Integral to the track 31 is the writing surface 32 which includes a flat writable surface 27 such as a dry-erase board spanning the length of the track 31. The writing surface 32 provides an area for the user to label the container 15 as desired. Various existing writing utensils can be utilized to write upon the writing surface 27 as desired by the user.

The first knob 41 is integral to a first gear 40. The first gear 40 is a toothed gear which rotates about a first gear axle 42 which is further attached to the bottom panel 25 and enables the first gear 40 to rotate freely. A user rotates the first knob 41 to simultaneously rotate the first gear 40 and further rotate an engaged month gear 43. The month gear 43 is also a toothed gear which is interlocked with the first gear 40 to translate the rotation of the first gear 40 to the month gear 43. The month gear 43 rotates about a month gear axle 44 which is also attached to the bottom panel 25 and enables the month gear 43 to rotate freely when the first gear 40 is rotated by the user manipulating the first knob 41. The month gear 43 includes the month gear indicia 45 which include a plurality of month numerals which correspond to the twelve months (12 mos.) that make up a year.

Likewise, the second knob 47 is integral to a second gear 46. The second gear 46 is also a toothed gear which rotates about a second gear axle 48 which is attached to the bottom panel 25 and enables the second gear 46 to rotate freely. A user rotates the second knob 47 to simultaneously rotate the second gear 46 and further rotate an engaged day gear 49. The day gear 49 is another toothed gear which is interlocked with the second gear 46 to translate the rotation of the second gear 46 to the day gear 49. The day gear 49 rotates about a day gear axle 50 which is also attached to the bottom panel 25 and enables the day gear 49 to rotate freely when the second gear 46 is rotated by the user manipulating the second knob 47. The day gear 49 includes the day gear indicia 51 which include a plurality of day numerals up to thirty-one (31) which correspond to the maximum day that could make up a month.

Lastly, the third knob 53 is integral to a third gear 52. The third gear 52 is another toothed gear which rotates about a third gear axle 54 attached to the bottom panel 25 and enables the third gear 52 to rotate freely. A user rotates the third knob 53 to simultaneously rotate the third gear 52 and further rotate an engaged year gear 55. The year gear 55 is a toothed gear which is interlocked with the third gear 52 to translate the rotation of the third gear 52 to the year gear 55. The year gear 55 rotates about a year gear axle 56 which is also attached to the bottom panel 25 and enables the year gear 55 to rotate freely when the third gear 52 is rotated by the user manipulating the third knob 53. The year gear 55 includes the year gear indicia 57 which include a plurality of year numerals for a plurality of consecutive years.

It is envisioned that other styles and configurations of the present device 10 can be easily incorporated into the teachings of the present disclosure, and only particular configurations have be shown and described for purposes of clarity and disclosure and not by way of limitation of scope.

The present device can be utilized by the common user in a simple and effortless manner with little or no training. After initial purchase or acquisition of the device 10, it can be installed as indicated in FIG. 1.

The method of installing and utilizing the device 10 may be achieved by performing the following steps: acquiring the device 10; depressing the fixed member 61 and the clamping member 62 towards each other to flex the spring 63 and open the gap 64 for placement upon a container 15; sliding the cover 29 within the track 31 via the handle 30 to write upon the writing surface 32 as desired; rotating the first knob 41 to simultaneously rotate the first gear 40 and month gear 43 to change the month gear indicia 45 as needed to be viewed through the month opening 34; rotating the second knob 47 to simultaneously rotate the second gear 46 and day gear 49 to change the day gear indicia 51 as needed to be viewed though the day opening 36; rotating the third knob 53 to simultaneously rotate the third gear 52 and year gear 55 to change the year gear indicia 57 as needed to be viewed through the year opening 38; removing and resetting the device 10 as needed; and, utilizing the device 10 to date the foodstuff within a container 15.

The foregoing embodiments of the disclosed date indicating device have been presented for purposes of illustration and description. They are not intended to be exhaustive or to limit the invention and method of use to the precise forms disclosed. It can be appreciated by one skilled in the art that other styles, configurations, and modifications of the invention can be incorporated into the teachings of the present disclosure upon reading the specification and that the embodiments of the disclosed baluster bracket assembly shown and described are for the purposes of clarity and disclosure and to limit the scope. The embodiments have been chosen and described in order to best explain the principles and practical application in accordance with the invention to enable those skilled in the art to best utilize the various embodiments with expected modifications as are suited to the particular use contemplated. The present application includes such modifications and is limited only by the scope of the claims.

What is claimed is:

1. A date indicating device comprising:

an enclosure defining a hollow internal volume, comprising:

a top panel;

a bottom panel opposite said top panel;

a front panel;

a rear panel laterally opposed to said front panel and comprising a writing surface;

a writing opening located on said front surface configured to expose said writing surface; and, a pair of longitudinally opposed side panels;

a spring clamp attached to an exterior of said enclosure;

a plurality of date indicia disposed within said internal volume and visible through said enclosure to visually indicate a date; and, a plurality of adjustable knobs disposed within said internal volume and mechanically connected to said date indicia configured to set said date.

2. The device of claim 1, further comprising a cover attached to said rear panel configured to cover said writing surface.

3. The device of claim 2, wherein said rear panel further comprises an integral track configured to slidably receive said cover.

4. The device of claim 1, wherein said enclosure further comprises a plurality of date openings configured to expose said plurality of date indicia.

5. The device of claim 1, wherein said enclosure further comprises a plurality of knob openings configured to expose said plurality of knobs.

6. The device of claim 1, wherein said spring clamp comprises:

a fixed member rigidly attached to said enclosure;

a U-shaped spring comprising an end attached to said fixed member and an opposing end; and, a clamping member attached to said opposing end of said spring;

wherein said spring biases said clamping member in a closed position; and, wherein said clamping member is movable to an open position relative to said fixed member about said spring.

7. The device of claim 1, wherein said plurality of knobs comprises:

a first knob rotatably attached to said rear panel and protruding through said front panel;

a second knob rotatably attached to said rear panel and protruding through said front panel; and, a third knob rotatably attached to said rear panel and protruding through said front panel.

8. The device of claim 7, wherein said front panel further comprises:

a first knob opening through which said first knob protrudes;

a second knob opening through which said first knob protrudes; and, a third knob opening through which said third knob protrudes.

9. The device of claim 7, wherein said plurality of date indicia comprises:

a month gear rotatably attached to said rear panel and mechanically connected to said first knob, said month gear comprising a plurality of month indicia visible through said front panel;

a day gear rotatably attached to said rear panel and mechanically connected to said second knob, said day gear comprising a plurality of day indicia visible through said front panel; and, a year gear rotatably attached to said rear panel and mechanically connected to said third knob, said year gear comprising a plurality of year indicia visible through said front panel.

10. The device of claim 9, wherein said front panel further comprises:

a month opening through which one of said plurality of month indicia is visible;

a day opening through which one of said plurality of day indicia is visible; and, a year opening through which one of said plurality of year indicia is visible.

11. A date indicating device comprising:

an enclosure comprising a top panel, a bottom panel opposite said top panel, a front panel, a rear panel laterally opposed to said front panel, and a pair of longitudinally opposed side panels defining a hollow internal volume;

a spring clamp attached to said enclosure;

a first knob rotatably attached to said rear panel and protruding through said front panel;

a second knob rotatably attached to said rear panel and protruding through said front panel;

a third knob rotatably attached to said rear panel and protruding through said front panel;

a month gear rotatably attached to said rear panel and mechanically connected to said first knob, said month gear comprising a plurality of month indicia visible through said front panel;

a day gear rotatably attached to said rear panel and mechanically connected to said second knob, said day gear comprising a plurality of day indicia visible through said front panel; and, a year gear rotatably attached to said rear panel and mechanically connected to said third knob, said year gear comprising a plurality of year indicia visible through said front panel.

12. The device of claim 11, wherein said spring clamp comprises:

a fixed member rigidly attached to said rear panel;

a U-shaped spring comprising an end attached to said fixed member and an opposing end; and, a clamping member attached to said opposing end of said spring;

wherein said spring biases said clamping member in a closed position; and, wherein said clamping member is movable to an open position relative to said fixed member about said spring.

13. The device of claim 12, wherein said front panel further comprises:

a first knob opening through which said first knob protrudes;

a second knob opening through which said first knob protrudes; and, a third knob opening through which said third knob protrudes.

14. The device of claim 13, wherein said front panel further comprises:

a month opening through which one of said plurality of month indicia is visible;

a day opening through which one of said plurality of day indicia is visible; and, a year opening through which one of said plurality of year indicia is visible.

15. The device of claim 14, wherein said rear panel further comprises a writing surface and said front panel comprises a writing opening configured to expose said writing surface.

16. The device of claim 15, further comprising a cover attached to said rear panel configured to cover said writing surface.

17. The device of claim 16, wherein said rear panel further comprises an integral track configured to slidably receive said cover.

18. The device of claim 17, wherein said enclosure and said spring clamp are made of plastic.

* * * * *